US006770828B2

(12) United States Patent
Smith

(10) Patent No.: US 6,770,828 B2
(45) Date of Patent: Aug. 3, 2004

(54) SYSTEM AND METHOD FOR ELECTRICAL CONTACTS AND CONNECTIONS IN SWITCHES AND RELAYS

(75) Inventor: Richard G. Smith, North Aurora, IL (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 78 days.

(21) Appl. No.: 09/961,860

(22) Filed: Sep. 24, 2001

(65) Prior Publication Data

US 2003/0057073 A1 Mar. 27, 2003

(51) Int. Cl.[7] ..... H01H 1/04
(52) U.S. Cl. ..... 200/263; 200/262; 200/268
(58) Field of Search ..... 200/262–270

(56) References Cited

U.S. PATENT DOCUMENTS 4,339,642 A * 7/1982 Seymour et al. ..... 200/153 G
4,345,130 A * 8/1982 Okutomi et al. ..... 200/268
4,374,311 A * 2/1983 Okahashi et al. ..... 200/269
4,622,269 A * 11/1986 Leung et al. ..... 428/550
4,817,695 A * 4/1989 Wingert et al. ..... 148/431
4,892,986 A * 1/1990 Watanabe et al. ..... 200/144 B

* cited by examiner

*Primary Examiner*—Elvin Enad
*Assistant Examiner*—K. Lee

(57) ABSTRACT

A switch assembly for use in an electrical apparatus includes a first contact having a first substrate and a first contact pad. The first contact pad is of copper or of a copper alloy. A second contact has a second substrate and a second contact pad. The second contact pad is of silver or of a silver alloy. The first contact is movably mounting relative to the second contact so that in a make position the first and second contact pads are in electrical contact with one another and in a break position the first and second contact pads are spaced from one another.

23 Claims, 2 Drawing Sheets

SYSTEM AND METHOD FOR ELECTRICAL CONTACTS AND CONNECTIONS IN SWITCHES AND RELAYS

TECHNICAL FIELD OF THE INVENTION

This invention relates to a switch assembly suitable for use in high power applications.

BACKGROUND OF THE INVENTION

A conventional switch assembly includes first and second contacts, with one of the contacts movably mounted relative to the other. The first and second contacts are typically formed of the same material. The contacts are movable between a break position spaced from one another and a make position in electrical contact with one another. A switch assembly in perhaps its most simple form consists of a wall mounted switch for turning a lamp, or the like, on or off. With such a switch assembly, the first and second contacts are formed of a conductive material such as copper. Copper contacts are relatively inexpensive. Also, the copper contacts are suitable for low power applications of this type.

In industrial control applications, switch assemblies are used in various electrical devices such as control relays, contactors, motor starters and the like. These devices may be used in low power applications. However, these devices are often also used in so-called "high power" applications. The high power applications may be up to 600 VAC and rated for 60 amps. Copper is not generally used in these applications because the higher voltage drop and higher currents can cause overheating which can create relatively high strength tack-welds between the contacts.

Silver cadmium oxide has long been considered a very good material for high power switching applications. The silver provides good conductivity and has no non-conductive oxides. The anti-welding features of the cadmium oxide makes any tack welds brittle enough to break in the normal operation of the devices. However, silver cadmium oxide is a more expensive contact material than copper. Therefore, use of contacts solely of silver cadmium oxide can be costly.

Accordingly, there is a need for lower cost contacts for use in high power applications.

SUMMARY OF THE INVENTION

In accordance with the invention, a switch assembly includes a copper contact pad paired with a high power contact material contact pad.

Broadly, there is disclosed in accordance with a first aspect of the invention a switch assembly for use in an electrical apparatus including a first contact having a first substrate and a first contact pad. The first contact pad is of copper or of a copper alloy. A second contact has a second substrate and a second contact pad. The second contact pad is of silver or of a silver alloy. Means are provided for movably mounting the first contact relative to the second contact so that in a make position the first and second pads are in electrical contact with one another and in a break position the first and second contact pads are spaced from one another.

It is a feature of the invention that the first and second substrates may be selected from a group consisting of copper, brass and steel.

It is another feature of the invention that the first contact pad may comprise silver-plated copper.

It is still another feature of the invention that the second contact pad may be of a material selected from a group consisting of silver, silver cadmium oxide, silver tin oxide and silver nickel.

It is still another feature of the invention that the first contact pad may be integrally formed in the first substrate.

There is disclosed in accordance with another aspect of the invention a switch assembly for use in an electrical apparatus suitable for high power applications comprising a first contact having a first substrate and a first contact pad. The first contact pad is of copper or of a copper alloy. A second contact has a second substrate and a second contact pad. The second contact pad is of a high power contact material. Means are provided for movably mounting the first contact relative to the second contact so that in a make position the first and second contact pads are in electrical contact with one another and in a break position the first and second contact pads are spaced from one another.

It is a feature of the invention that the second contact pad may be of a material selected from a group consisting of silver, silver alloy, silver semi-refractory material, silver refractory material and tungsten.

It is disclosed in accordance with yet another aspect of the invention an electrical switch comprising a housing. A stationary contact is fixedly mounted in the housing and has a stationary substrate and a stationary contact pad. A movable contact has a movable substrate and a movable contact pad. The movable contact is movably mounted in the housing so that in a make position the stationary and movable contact pads are in electrical contact with one another and in a break position the stationary and movable contact pads are spaced from one another. One of the stationary contact pad and the movable contact pad is of copper or of a copper alloy, and the other of the stationary contact pad and the movable contact pad is of silver or of a silver alloy.

Further features and advantages of the invention will be readily apparent from the specification and from the drawings.

DETAILED DESCRIPTION OF THE INVENTION

Figure 1:
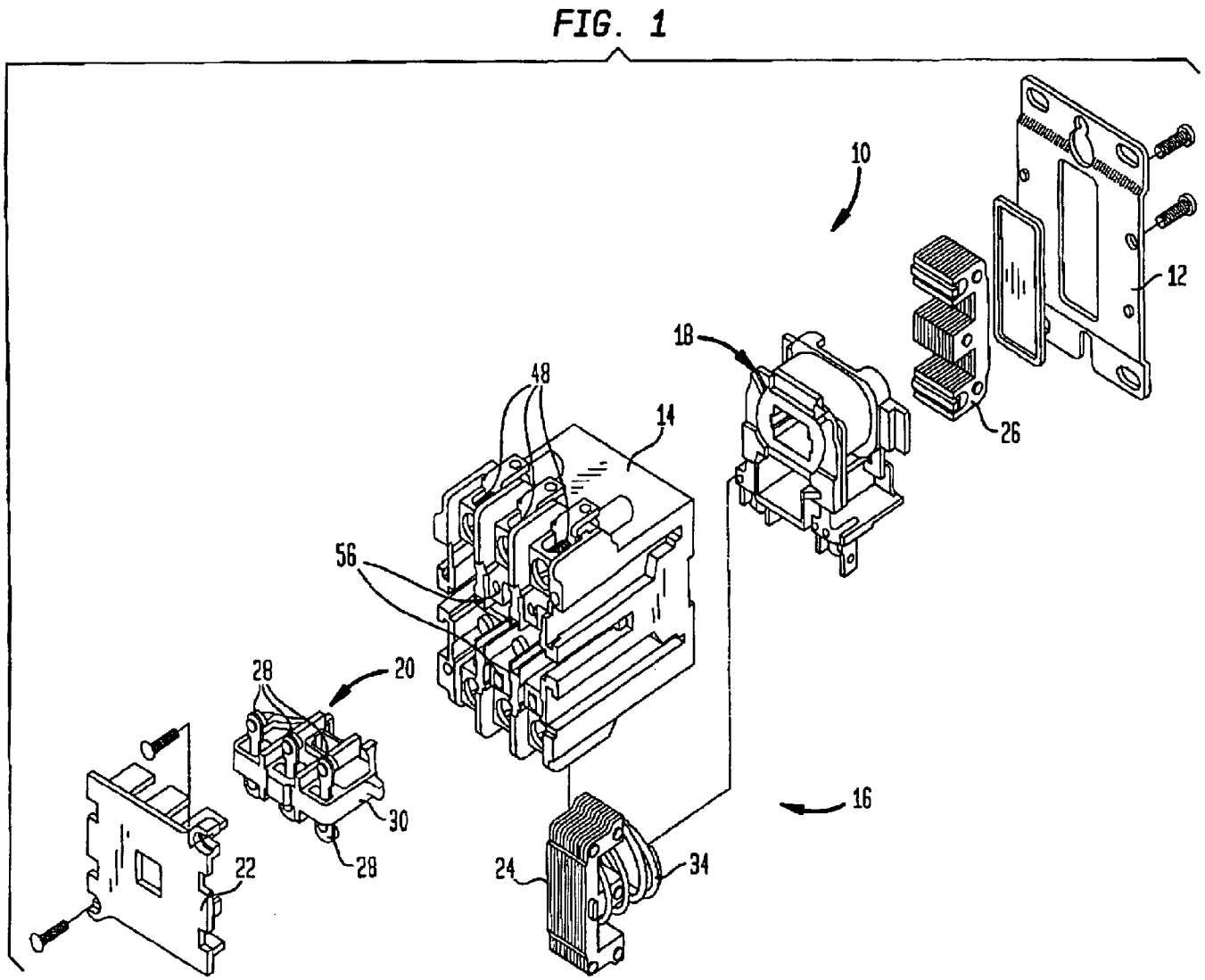
FIG. 1 is an exploded, perspective view of an electromagnetically actuable device in the form of a contactor including electrical contacts in accordance with the invention.

Referring initially to FIG. 1, an electromagnetically actuable device in the form of an electrical contactor 10 is illustrated in exploded form. The contactor 10 includes a base 12, a housing 14, an electromagnet 16, a coil 18, a switching assembly 20 and a cover plate 22. The electromagnet 16 includes an armature 24 and a core 26. The housing 14 is mounted to the base 12 and encloses the coil 18 and the core 26. The coil 18 is fixedly mounted in the housing 14. Likewise, the core 26 is fixedly mounted in the housing 14 and is generally "E" shaped and is received in the coil 18 in a conventional manner. The coil 18 includes conventional bobbin, winding and terminal assembly. The armature 24 is mechanically linked with a contact carrier 30 of the switching assembly 20 in a conventional manner. Particularly, the contact carrier 30 moves with the armature 24. The switching assembly 20 includes movable contacts 28 supported on the contact carrier 30. The housing 14 supports stationary contacts 32 positioned in proximity with the movable contacts 28.

A return spring 34 is disposed between the armature 24 and the coil 18. The return spring 34 biases the armature 24 away from the core 26. When the coil 18 is energized, the movable armature 24 is drawn toward the core 26 in a conventional manner. The movement of the armature 24 and thus the contact carrier 30 toward the core 26 causes the movable contacts 28 to selectively open or close an electrical circuit with the stationary contacts 32, as is known. The stationary contacts 32 are electrically connected to terminals 48 for electrical connection to external circuits in a conventional manner.

While this application illustrates an electromagnetically actuable device in the form of a contactor, the teachings of the invention can similarly be applied to other electromagnetically actuable devices such as motor starters, control relays, or the like. Each such device includes a switching assembly designed according to its intended function.

In accordance with the invention, the switching assembly 20 uses contacts of different materials.

Figure 2:
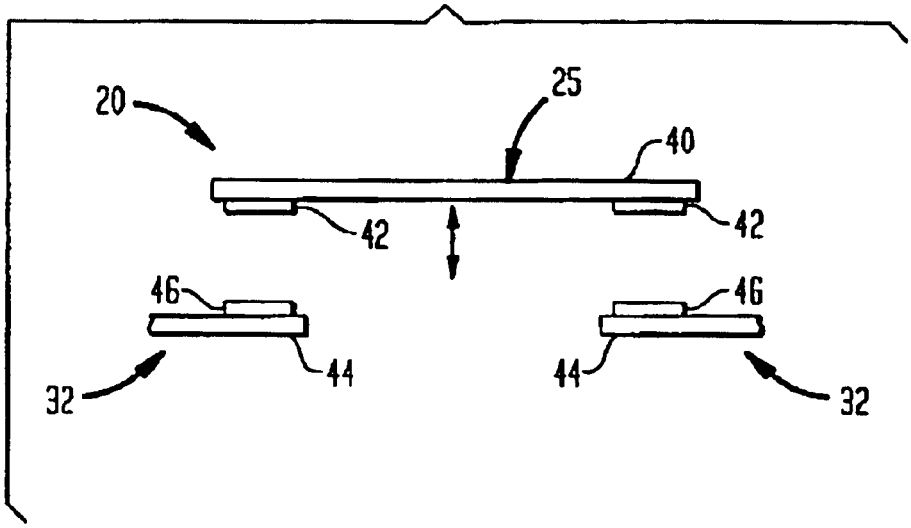
FIG. 2 is a side elevation view, with parts removed for clarity, of a switch assembly for the electrical apparatus of FIG. 1 in a break position.
Figure 3:
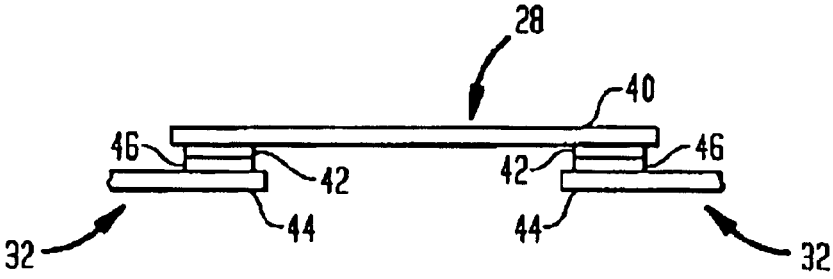
FIG. 3 is a view similar to that of FIG. 2 with the switch assembly in a make position.

Particularly, referring to FIG. 2, a portion of the switching assembly 20 is illustrated with other components removed for clarity. The switching assembly 20 in the illustrated embodiment of the invention comprises a double break electrical contact switch assembly. As such, the switch assembly 20 comprises two spaced stationary contacts 32 along with the movable contact 28 that electrically bridges the two stationary contacts 32. The movable contact 28 includes an electrically conductive bar or substrate 40 mounting two spaced contact pads 42. Similarly, each stationary contact 32 comprises an elongate bar or substrate 44 each having a contact pad 46. The stationary contact contact pads 46 are positioned in alignment with the movable contact contact pads 42. The contact carrier 30, see FIG. 1, is employed to move the movable contact 28 toward and away from the stationary contacts 32. Particularly, FIG. 2 illustrates the movable contact 28 in a break position with the movable contact contact pads 42 spaced from the fixed contact contact pads 46. Conversely, FIG. 3 illustrates the movable contacts 28 in a make position with the movable contact contact pads 42 in electrical contact with the fixed contact contact pads 46.

The movable contact substrate 40 and fixed contact substrates 44 are formed of a conductive material such as copper, brass or steel. Additionally, either the movable contact contact pads 42 or the stationary contact contact pads 46 are made of copper or a copper alloy. The other of the movable contact contact pads 42 and stationary contact contact pads 46 are of a high power contact material. Particularly, the high power contact material is adapted to switch higher power circuits than would be switched by switch assemblies using only copper or copper alloy for contact pads. Such high power applications may include electrical contactors or starters or the like rated for 600 volt AC and 600 ampere operation.

The high power contact material may be of silver or of a silver alloy. Typical silver alloys used for contact materials include silver cadmium oxide (AgCdO), silver tin oxide ($AgSnO_2$) and silver nickel (AgNi). Examples of silver cadmium oxide compositions are 90-10, 85-15 and 87-12-1. In each example, the first numeral represents percent of silver, the second numeral percent of cadmium oxide, and, in the last example, the third numeral represents percent of other materials. Examples of silver tin oxide compositions are also 90-10, 85-15 and 87-12-1.

Other suitable high power contact materials include silver semi-refractory materials, silver refractory materials and tungsten. The silver and silver alloy materials exhibit high conductivity and are capable of carrying higher currents. Silver semi-refractory materials are capable of handling higher current loads than most silver alloys. They have the high conductivity of silver. Silver refractory materials are higher in refractory content.

The copper contact pads may consist of silver-plated copper. The plating prevents green oxide from forming on the copper contact pads.

By paring copper or silver-plated copper contact pads as one surface and the opposing surface being of a higher power contact material, as discussed above, the transfer of material in the arc and the interface and welding causes enough of the more expensive high power material to transfer to the copper face to provide adequate operation.

The contact pads 42 and 46 may be electrically connected to the respective substrates 40 and 44 by welding, riveting or brazing. Additionally, the copper contact pads do not need to be an actual pad or "button" applied to the substrate. Instead, the substrate may be fabricated of copper and formed using any known forming technique to provide a contact pad surface.

Using a switching assembly including a copper contact pad in connection with a more expensive high power contact material reduces manufacturing costs significantly and still provides a device that meets listing requirements.

While the switching assembly 20 described herein is a double break contact, the teachings of the invention could similarly be applied to a single break contact. Likewise, the switching assembly could be used with electrical apparatus other than an electromagnetically actuable device such as shown in FIG. 1. For example, the switching assembly 20 could be used with a manually actuated device. The teachings of the invention do not relate to the actuation means for providing movement of the movable contact relative to the stationary contact, but rather the use of a paired copper contact material and high power contact material in the switching assembly.

It can therefore be appreciated that a new and novel system and method for electrical contacts and connections switches and relays has been described. It will be appreciated by those skilled in the art that, given the teaching herein, numerous alternatives and equivalents will be seen to exist which incorporate the disclosed invention. As a result, the invention is not to be limited by the foregoing exemplary embodiments, but only by the following claims.

What is claimed is:

1. A switch assembly for use in an electrical apparatus comprising:

a first contact having a first substrate and a first contact pad, the first contact pad being of copper or of a copper alloy;

a second contact having a second substrate and a second contact pad, the second contact pad being of silver or of a silver alloy; and means for movably mounting the first contact relative to the second contact so that in a make position the first and second contact pads are in electrical contact with one another and in a break position the first and second contact pads are spaced from one another.

2. The switch assembly of claim 1 wherein the first and second substrates are of a material selected from a group consisting of copper, brass and steel.

3. The switch assembly of claim 1 wherein the first contact pad comprises silver plated copper.

4. The switch assembly of claim 1 wherein the second contact pad is of a material selected from a group consisting of silver, silver cadmium oxide, silver tin oxide and silver nickel.

5. The switch assembly of claim 1 wherein the first contact pad is integrally formed in the first substrate.

6. A switch assembly for use in an electrical apparatus suitable for high power applications, comprising:

a first contact having a first substrate and a first contact pad, the first contact pad being of copper or of a copper alloy;

a second contact having a second substrate and a second contact pad, the second contact pad being of a high power contact material; and means for movably mounting the first contact relative to the second contact so that in a make position the first and second contact pads are in electrical contact with one another and in a break position the first and second contact pads are spaced from one another.

7. The switch assembly of claim 6 wherein the first and second substrates are of a material selected from a group consisting of copper, brass and steel.

8. The switch assembly of claim 6 wherein the first contact pad comprises silver plated copper.

9. The switch assembly of claim 6 wherein the second contact pad is of a silver or silver alloy material.

10. The switch assembly of claim 9 wherein the second contact pad is of a material selected from a group consisting of silver, silver cadmium oxide, silver tin oxide and silver nickel.

11. The switch assembly of claim 6 wherein the first contact pad is integrally formed in the first substrate.

12. The switch assembly of claim 6 wherein the second contact pad is of a material selected from a group consisting of silver, silver alloy, silver semi-refractory material, silver refractory material and tungsten.

13. An electrical switch comprising:

a housing;

a stationary contact fixedly mounted in said housing and having a stationary substrate and a stationary contact pad; and a moveable contact having a moveable substrate and a moveable contact pad, the moveable contact being movably mounted in said housing so that in a make position the stationary and moveable contact pads are in electrical contact with one another and in a break position the stationary and moveable contact pads are spaced from one another, wherein one of the stationary contact pad and the moveable contact pad is of copper or of a copper alloy, and the other of the stationary contact pad and the moveable contact pad is of silver or of a silver alloy.

14. The electrical switch of claim 13 wherein the stationary and moveable substrates are of a material selected from a group consisting of copper, brass and steel.

15. The electrical switch of claim 13 wherein the one of the stationary contact pad and the moveable contact pad comprises silver plated copper.

16. The electrical switch of claim 13 wherein the other of the stationary contact pad and the moveable contact pad is of a material selected from a group consisting of silver, silver cadmium oxide, silver tin oxide and silver nickel.

17. The electrical switch of claim 13 wherein the one of the stationary contact pad and the moveable contact pad is integrally formed in the associated stationary or moveable substrate.

18. The method of assembling a switch assembly for use in an electrical apparatus suitable for high power applications, comprising:

providing a first contact having a first substrate and a first contact pad, the first contact pad being of copper or of a copper alloy;

providing a second contact having a second substrate and a second contact pad, the second contact pad being of a high power contact material; and mounting the first contact for movement relative to the second contact so that in a make position the first and second contact pads are in electrical contact with one another and in a break position the first and second contact pads are spaced from one another.

19. The method of claim 18 wherein providing a first contact comprises the first contact pad comprising silver plated copper.

20. The method of claim 18 wherein providing a second contact comprises the second contact pad being of a silver or silver alloy material.

21. The method of claim 20 wherein the second contact pad is of a material selected from a group consisting of silver, silver cadmium oxide, silver tin oxide and silver nickel.

22. The method of claim 18 wherein providing a first contact comprises the first contact pad being integrally formed in the first substrate.

23. The method of claim 18 wherein providing a second contact comprises the second contact pad being of a material selected from a group consisting of silver, silver alloy, silver semi-refractory material, silver refractory material and tungsten.

* * * * *